United States Patent [19]

Lefebvre

[11] 4,082,495

[45] Apr. 4, 1978

[54] FLAME RETENTION HEAD ASSEMBLY

[76] Inventor: Denis Lefebvre, 3354 rue Windsor, app. 4, St.-Hubert, Quebec, Canada

[21] Appl. No.: 658,745

[22] Filed: Feb. 17, 1976

[51] Int. Cl.[2] ..... F23M 9/00

[52] U.S. Cl. ..... 431/183; 239/406

[58] Field of Search ..... 431/8, 182, 183, 185, 431/186, 265, 352; 239/405, 406

[56] References Cited

U.S. PATENT DOCUMENTS

| | | | |
|---|---|---|---|
| 1,193,701 | 8/1916 | Kermode | 431/183 |
| 2,513,645 | 7/1950 | Hallinan | 431/183 |
| 3,650,477 | 3/1972 | Gulliksson | 431/265 X |
| 3,694,135 | 9/1972 | Dancy et al. | 431/265 |
| 3,733,169 | 5/1973 | Lefebvre | 431/265 |

FOREIGN PATENT DOCUMENTS

| | | | |
|---|---|---|---|
| 37,914 | 1/1970 | Japan | 239/406 |

*Primary Examiner*—William F. O'Dea
*Assistant Examiner*—Harold Joyce
*Attorney, Agent, or Firm*—Raymond A. Robic; Arthur Schwartz; Francis B. Francois

[57] ABSTRACT

An improved flame retention head assembly for use in the air tube of a fuel burner having a fuel nozzle in the tube. The assembly includes a tubular member having in sequence a conical, cylindrical, and flared section with air-fuel mixing means in the conical section, and air passage means in the cylindrical and flared sections. The size of the air passage means in the cylindrical section can be adjusted. This device with its air level combinations, allows an excess of combustion air of 5 to 15% only, thus resetting in flame temperatures of more than 3,000° F.

8 Claims, 4 Drawing Figures

FIG. 1
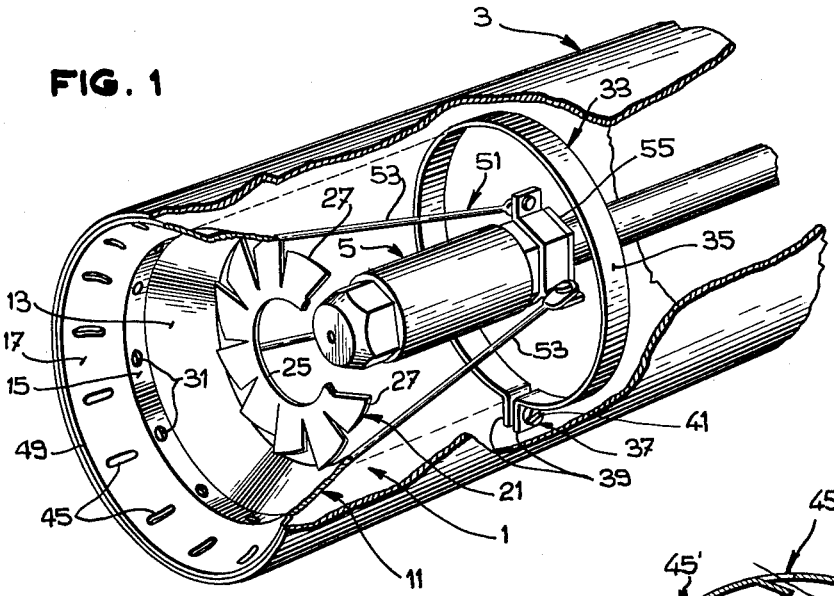
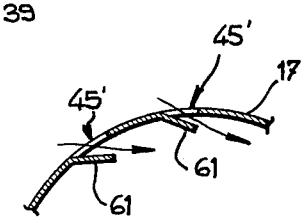
FIG. 4
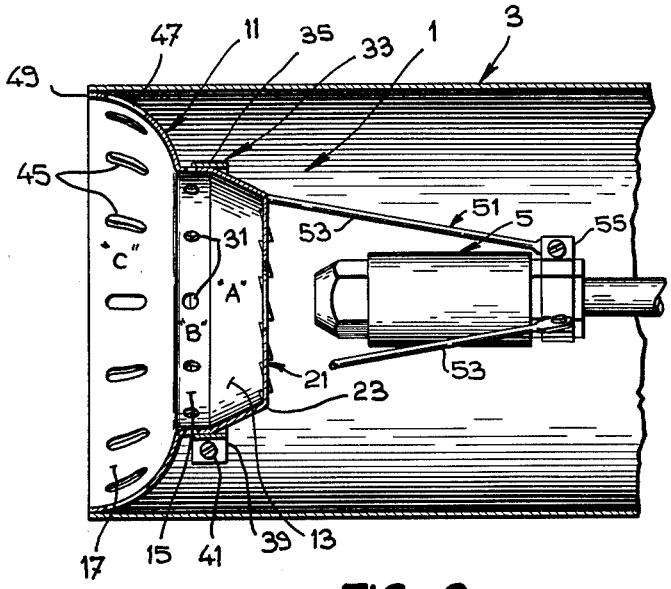
FIG. 2
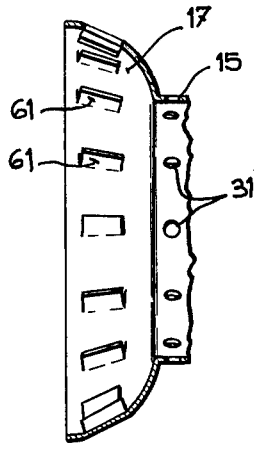
FIG. 3

FLAME RETENTION HEAD ASSEMBLY

This invention is directed to improvements in fuel burners using oil or gas.

More particularly, the invention is directed toward improvements in flame retention head assemblies used in fuel burners.

Flame retention head assemblies are used to confine the fuel sprayed from a nozzle, and the resulting flame, in a specific pattern, thus eliminating the need for a combustion chamber. The assemblies provide an increase in heat transfer from the burner thereby improving burner efficiency, and also improve flame stability.

Effective flame retention head assemblies have means for rapidly mixing the sprayed fuel with air to obtain air-fuel mixes providing the best possible combustion efficiency. One effective known assembly is shown in my earlier U.S. Pat. No. 3,733,169, issued May 15, 1973. This assembly employs both a spinner plate and a slotted flange, spaced downstream from the spinner plate, to swirl and mix air and fuel for good combustion results.

It has however been discovered that even more efficient combustion results, and flame pattern control, can be obtained by providing an additional air supplying means between the spinner plate and slotted flange. More importantly, this air supplying means can be adjusted to control the amount of air supplied, thus providing much better control over the combustion process.

Other changes to the assembly, as will be apparent, have also been made to provide a more efficient turbulence, thus combustion process.

The invention is particularly directed toward a flame retention head assembly for use in the air tube of a fuel burner having a fuel nozzle. The assembly has a tubular member which includes a conical section, and an adjacent cylindrical section. The cylindrical section is joined to the large end of the conical section. A spinner plate is mounted in the small end of the conical section having a central opening and vanes in its outer periphery. Openings are also provided in the cylindrical section for passing air into the tubular member when the assembly is in operation.

An embodiment of the invention will now be described in detail having reference to the accompanying drawings in which:

FIG. 1 is a perspective view of the flame retention head assembly installed in an air tube;

FIG. 2 is a partial cross-section view of the assembly in the air tube;

FIG. 3 is a detail view of an alternative construction for part of the assembly; and FIG. 4 is a cross-sectional detail view of the alternative construction shown in FIG. 3.

As shown in FIGS. 1 and 2 the flame retention head assembly 1 is to be mounted within the air tube 3 of a fuel burner and in front of a fuel nozzle 5 mounted coaxially within tube 3.

The assembly 1 has a circular tubular member 11. The tubular member 11 preferably has three sections; a first conical section 13 at one end, a second intermediate cylindrical section 15 which is joined at one end to the large end of conical section 13, and an outwardly flaring flange 17 extending from the other end of the cylindrical section 15.

A spinner plate 21 is mounted at the small end 23 of the conical section 13 of member 11. The plate 21 extends perpendicular to the longitudinal axis of the tubular member 11. The spinner plate 21 has a central fuel and air opening 25, and vanes 27 about its peripheral edge for imparting an initial swirling motion to the air and fuel mixture within member 11.

A circular row of circular openings 31 are provided about cylindrical section 15 in member 11 to pass air. Means 33 (shown out of position in FIG. 1) are preferably provided to adjust the effective working size of these openings 31. The adjustment means 33 can comprise a flexible strap or band 35 with means 37 at its ends 39 for tightening or clamping the strap 35 about cylindrical section 15. The tightening means 37 comprise a bolt or screw 41 threaded through holes in the ends 39 of strap 35. To adjust the working size of openings 31, the strap 35 is loosened and slid along cylindrical section 15 to cover a desired portion of opeings 31. The strap 35 is then tightened in place.

A circular row of elongated slots 45 are also provided in flange 17 to pass air. The slots 45 are angled to provide a further swirling motion to the air passed, the swirling motion being in the same direction (or opposite resulting in more violent mixtures) as that initially imparted by vanes 27. The flange 17 is dished to provide an outer convex surface 47. This shape reduces "combustion" noise from the assembly during use. The diameter of the outer edge 49 of flange 17 is substantially the same as the inner diameter of tube 3 as shown in FIG. 2.

Means 51 are provided for mounting the assembly 1 within tube 3. The mounting means 51 comprise rods 53 attached at one end to the end 23 of conical section 13. The other ends of the rods 53 are attached to a bracket 55 mounted about nozzle adaptor 5. The assembly 1 is mounted concentrically within tube 3 with spinner plate 21 just in front of nozzle 5 and with opening 25 centered with respect to the nozzle.

During operation of the air burner, ignition air is supplied from the air tube 3, along with fuel from nozzle 5, through opening 25 in spinner plate 21 into conical section 13 of member 11. Primary combustion takes place in a first mixing and heating zone chamber "A" defined by section 13, aided by the swirling action imparted to the burning fuel-air mixture by air passing through vanes 27 in plate 21.

Cylindrical section 15 provides a second mixing chamber "B" into which air is passed via openings 31 to promote more complete combustion. The amount of air can be varied if adjusting means 33 are employed in reaction zone.

Flange section 17 provides a third mixing chamber "C" also defined as luminous flame zone, into which air is swirled via slots 45. Since the slots 45 are preferably angled, a swirling action is provided to ensure better combustion.

Various modifications can be made to the assembly described. Instead of elongated cut out slots 45, the flange 17 can be provided with punched slots 45' as shown in FIGS. 3 and 4. The flaps 61 punched inwardly to form slots 45' provide guide means inducing a better swirling action.

Either slots 45 or 45' can be angled to provide a swirling motion in opposition to that provided vanes 27 to obtain a more violent mixture.

If desired, flange 17 can be made slightly smaller in diameter than the inside diameter of tube 3. Fingers (not shown) would extend radially out from the flange to position it within tube 3. The annular gap between flange 17 and tube 3 provides for an air flow which cools the tube and assembly 1.

The annular gap also helps produce a narrower and longer flame pattern due to the high speed air flow from the gap. The closer the flange is positioned to the tube, the shorter and wider the flame pattern becomes.

The shape of conical section 13 can also be used to determine the flame speed. A wide angled conical section 13 decreases flame speed while a narrow angled conical section 13 increases flame speed.

It will be seen that many adjustments or variations can be made in the basic assembly to provide optimum combustion efficiency. The assembly of the present invention has been found to provide a very high flame temperature as compared to known conventional equipment. The assembly also is very economical, reducing fuel requirements by up to 25%, and clean, reducing combustion emissions by up to 75%. This is due to the more complete combustion obtained by the assembly. The assembly makes much more efficient use of the air flow in tube 3. When flange 17 is spaced from tube 3, five different air paths are provided to mix, swirl and shape the flame. Even when flange lies against tube 3, four air paths are still provided, to supply constant combustion air ratio. For example, when flange 17 lies against tube 3, band 35 is loosened and adjusted so as to compensate combustion air change.

I claim:

1. A three-stage flame retention head assembly for use in the air tube of a fuel burner having a fuel nozzle mounted coaxially within the air tube, said assembly comprising:

(a) a tubular member concentrically mounted within said air tube just in front of the fuel nozzle, said tubular member comprising a conical section, a cylindrical section joined at one end thereof to the larger end of said conical section, and an outwardly flaring flage section joined at the smaller end thereof to the other end of said cylindrical section, said outwardly flaring flange section being dished to provide a convex outer surface;

(b) a spinner plate mounted in the smaller end of said conical section of said tubular member and adapted to mix and swirl air and fuel, said spinner plate having a central opening therein defined by a continuous annulus, and having vanes in its outer periphery extending outwardly from said continuous annulus;

(c) said cylindrical section of said tubular member having circumferentially spaced openings therein; and (d) said outwardly flaring flange section having a row of circumferentially spaced, elongated slots therein, said openings and said elongated slots passing air into the tubular member when the assembly is in operation, said conical section providing a first mixing and heating chamber wherein primary combustion takes place, said cylindrical section providing a second mixing chamber, and said flange section providing a third mixing chamber.

2. An assembly as claimed in claim 1 including means for adjusting the size of the openings in the cylindrical section.

3. An assembly as claimed in claim 2 wherein the adjusting means comprise a strap which can be tightly mounted about the cylindrical section to cover a desired portion of the openings.

4. An assembly as claimed in claim 1 wherein the flange section has substantially the same outer diameter as the inner diameter of the air tube.

5. An assembly as claimed in claim 1 wherein the flange section has an outer diameter less than the inner diameter of the air tube to provide an annular opening for air flow when the assembly is mounted in the air tube.

6. An assembly as claimed in claim 1, wherein both the vanes in said spinner plate and the elongated slots in the flange are arranged to swirl passing air in the same direction.

7. An assembly as claimed in claim 1, wherein the elongated slots in the flange are arranged to swirl passing air in a direction opposite to that air swirled by the vanes in said spinner plate.

8. An assembly as claimed in claim 1, wherein each elongated slot in the flange has a flap extending from one longitudinal side thereof.

* * * * *